US007578217B2

(12) United States Patent
Hobbs et al.

(10) Patent No.: US 7,578,217 B2
(45) Date of Patent: Aug. 25, 2009

(54) MANUFACTURING RAZOR BLADES

(75) Inventors: Stephen F. Hobbs, West Bridgewater, MA (US); Cheng-Jih Li, Hopkinton, MA (US)

(73) Assignee: The Gillette Company, Boston, MA (US)

( * ) Notice: Subject to any disclaimer, the term of this patent is extended or adjusted under 35 U.S.C. 154(b) by 0 days.

(21) Appl. No.: 11/259,553

(22) Filed: Oct. 26, 2005

(65) Prior Publication Data

US 2007/0089568 A1 Apr. 26, 2007

(51) Int. Cl.
*B21K 5/00* (2006.01)

(52) U.S. Cl. ..... 76/116; 76/104.1

(58) Field of Classification Search ..... 76/116, 76/104.1, DIG. 8, DIG. 9, 101.1; 72/205, 72/206

See application file for complete search history.

(56) References Cited

U.S. PATENT DOCUMENTS

| | | | | | |
|---|---|---|---|---|---|
| 1,370,381 | A | * | 3/1921 | Tarbox | 76/1 |
| 1,734,554 | A | * | 11/1929 | Behrman | 76/104.1 |
| 1,916,416 | A | * | 7/1933 | Connolly | 76/104.1 |
| 2,016,770 | A | * | 10/1935 | De Bats | 72/203 |
| 2,226,948 | A | * | 12/1940 | Simons | 72/137 |
| 2,275,517 | A | | 3/1942 | Fay | |
| 2,593,307 | A | | 4/1952 | Jacobsen | |
| 2,989,804 | A | * | 6/1961 | Yellon | 30/32 |
| 3,279,283 | A | * | 10/1966 | Craig | 76/104.1 |
| 3,374,700 | A | * | 3/1968 | Mages | 83/674 |
| 3,600,804 | A | | 8/1971 | Brown | |
| 3,653,245 | A | * | 4/1972 | Tishken | 72/187 |
| 3,847,683 | A | * | 11/1974 | Sastri | 148/608 |
| 3,996,780 | A | * | 12/1976 | German | 72/187 |
| 4,011,109 | A | * | 3/1977 | Golland et al. | 148/599 |
| 4,109,500 | A | * | 8/1978 | Franek | 72/203 |
| 4,259,126 | A | * | 3/1981 | Cole et al. | 148/621 |
| 4,282,996 | A | * | 8/1981 | Maeda et al. | 225/2 |
| 5,337,592 | A | * | 8/1994 | Paulson | 72/177 |
| 5,458,025 | A | * | 10/1995 | Neamtu | 76/104.1 |
| 5,661,907 | A | | 9/1997 | Apprille, Jr. | |
| 5,701,788 | A | | 12/1997 | Wilson et al. | |
| 5,983,756 | A | * | 11/1999 | Orloff | 76/104.1 |
| 6,357,273 | B1 | * | 3/2002 | Noe et al. | 72/234 |
| 6,629,475 | B1 | * | 10/2003 | Neamtu et al. | 76/104.1 |
| 6,957,598 | B2 | * | 10/2005 | Neamtu et al. | 76/104.1 |
| 7,140,113 | B2 | * | 11/2006 | King et al. | 30/346.54 |
| 2004/0187644 | A1 | * | 9/2004 | Peterlin et al. | 76/104.1 |
| 2007/0089567 | A1 | * | 4/2007 | Li et al. | 76/116 |
| 2007/0163390 | A1 | * | 7/2007 | Hobbs et al. | 76/104.1 |

FOREIGN PATENT DOCUMENTS

| | | |
|---|---|---|
| GB | 548647 | 10/1942 |
| WO | WO 98/05478 | 2/1998 |

OTHER PUBLICATIONS

Hobbs et al., U.S. Appl. No. 11/259,528, entitled "Manufacturing Razor Blades", filed Oct. 26, 2005.

* cited by examiner

*Primary Examiner*—Joseph J Hail, III
*Assistant Examiner*—Robert Scruggs
(74) *Attorney, Agent, or Firm*—Joanne N. Pappas; Kevin C. Johnson; Steven W. Miller

(57) ABSTRACT

A method of making razor blades from a strip material includes offsetting and flattening steps.

12 Claims, 8 Drawing Sheets

MANUFACTURING RAZOR BLADES

TECHNICAL FIELD

This invention relates to manufacturing razor blades.

BACKGROUND

Razor blades are typically made from a continuous strip of stock material that is hardened and sharpened while the strip travels along a processing line. The strip is then divided in blade length sections used in the manufacture of individual razor cartridges.

In some applications, blades are supported on bent supports that are slidably mounted in the cartridge housing to move up and down during shaving. For example, FIG. 1 shows cartridge 10 with blades 12 slidably mounted in housing 14, and FIG. 2 shows a blade 12 on a support 16. In these applications, the blades cannot overlap and thus have a small dimension "a" from the cutting edge 18 to the back edge 20. The strip material and blade sections, however, must have a sufficient distance from the front edge to the back edge in order to properly secure and hold the material and sections during processing and attaching to blade supports. It thus is necessary to remove a portion of the blade material after processing and attaching so that the blade will have the desired small dimension from the cutting edge to the back edge. In some applications, the rear section 22, shown in FIG. 3, is removed by bending the rear section 22 between 60° and 90° with respect to the front section 24 after the front section has been attached to the blade support. FIG. 3 also shows spot weld 26, used to attach blade 12 to support 16. There typically is an upturned portion at the rear edge 20 of the attached blade section where the rear section has been removed. In some cases the rear section 22 is not easily removed.

In U.S. Pat. No. 6,629,475, a method of manufacturing razor blades is described in which the strip material is offset to provide a portion 22 that is easier to remove.

SUMMARY

The invention generally relates to methods of manufacturing razor blades that include offsetting a strip material.

In one aspect of the invention, the method includes (a) offsetting a first lengthwise-extending portion of the strip material from a second lengthwise-extending portion of the strip material; (b) flattening the first lengthwise-extending portion and the second lengthwise-extending portion to remove at least 50% of the offset; (c) separating the first lengthwise-extending portion from the second lengthwise-extending portion; and (d) converting the first lengthwise-extending portion into razor blades.

In some embodiments, the method further includes (e) sharpening a lengthwise-extending edge on the first lengthwise-extending portion after step (b) and before step (c); and (f) separating the first lengthwise-extending portion into razor blade length sections. Each razor blade length section includes part of the first lengthwise-extending portion and part of the second lengthwise-extending portion, and step (c) includes separating the first lengthwise-extending portion from the second lengthwise-extending portion on each of the razor blade length sections to provide razor blades.

In some embodiments, the first lengthwise-extending portion and the second lengthwise-extending portion are of approximately equal width and both portions are converted into razor blades.

Flattening the strip material, after offsetting, can make the strip material easier to process, for example, during subsequent heat treating and/or sharpening.

In another aspect of the invention, the method includes offsetting the strip material at a plurality of locations across its width. Offsetting is greater at a first location than at a second location. The offset strip material subsequently is converted into razor blades. In some embodiments, the conversion includes (i) separating the offset strip material at the first location to provide a first offset strip material portion including the second location; (ii) sharpening a lengthwise-extending edge on the first offset strip material portion; (iii) separating the first offset strip material portion into razor blade length sections; and (iv) separating the razor blade length sections at the second location to provide razor blades.

In some embodiments, offsetting occurs at least three locations across the width of the strip material. Offsetting is greater at the first location than at the second location and the third location, and the first location is between the second location and third location. In some embodiments, step (i) provides the first offset strip material as well as a second offset strip material including the third offset location, and the method further includes (v) sharpening a lengthwise-extending edge on the second offset strip material portion; (vi) separating the second offset strip material portion into razor blade length sections; and (vii) separating the razor blade length sections at the third location to provide razor blades.

Optionally, the above approach can be expanded, for example, to include six, eight, ten, twelve, or even more offset locations.

Offsetting the strip material different amounts at different locations provides manufacturing flexibility. A location with a large offset generally can be separated with less force than a location that has a smaller offset.

In another aspect of the invention, the method includes offsetting a first lengthwise-extending portion of the strip material from a second lengthwise-extending portion of the strip material at the same location at least twice. In some embodiments, flattening is performed between the offsetting steps. The method further includes separating the first lengthwise-extending portion from the second lengthwise-extending portion and converting the first lengthwise-extending portion into razor blades.

Offsetting a second time at the same location has the benefit, for example, of allowing tension on the strip material to be adjusted after the initial offsetting if, the initial offsetting also thins the strip material.

In preferred embodiments of any of the above methods the strip material is a metal, for example, stainless steel.

Other aspects of the invention include the strip materials themselves, razor blades, and razor blade precursors made from strip materials using any of the above methods, and razors including razor blades made using any of the above methods.

"Offsetting", as used herein, means that a first portion of a strip material is offset in thickness from a second portion of the strip material. In preferred embodiments, offsetting occurs on both the upper surface and lower surface of the strip material.

"Strip material" means an elongated, flat strip of material, for example, stainless steel or another metal that is at least 500 feet, at least 1,000 feet, or even at least 5,000 feet long.

Length, width, thickness, upper, and lower as applied to the strip materials is explained below during the discussion of FIGS. 5 and 6.

Other aspects, features, and advantages of the method will be apparent from the Figures, the Detailed Description, and from the claims.

DETAILED DESCRIPTION

Figure 1:
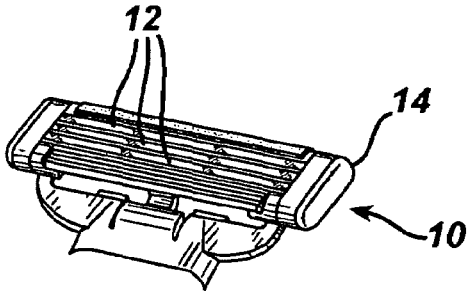
FIG. 1 PRIOR ART
FIG. 1 is a perspective view of a shaving razor cartridge.
Figure 2:
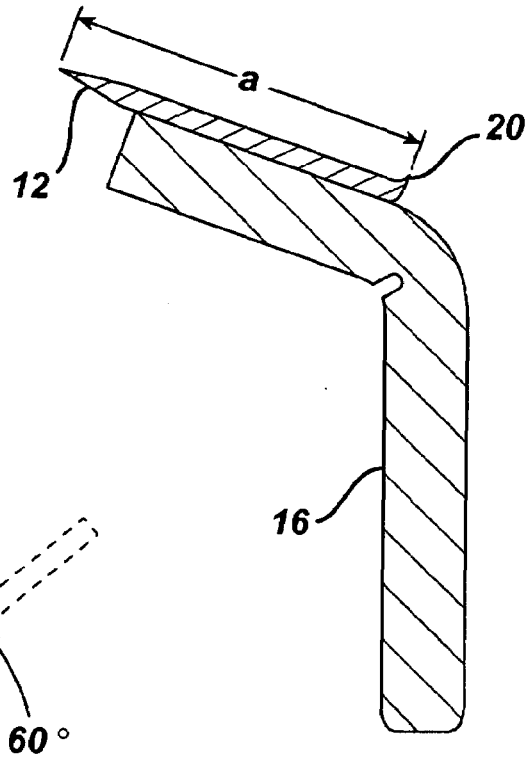
FIG. 2 PRIOR ART
FIG. 2 is a section showing a prior art razor blade used in the FIG. 1 cartridge.
Figure 3:
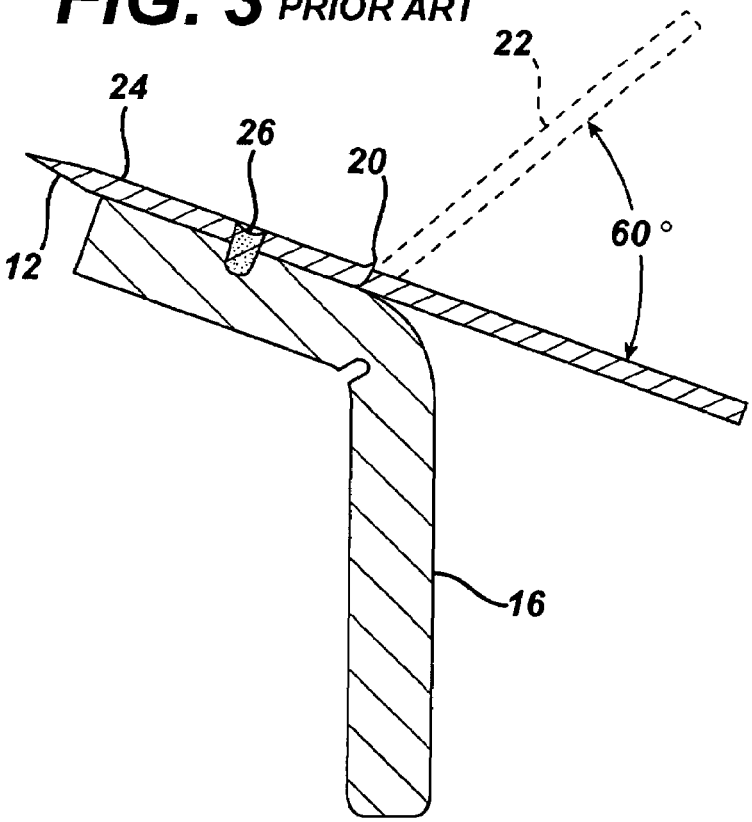
FIG. 3 PRIOR ART
FIG. 3 is a section showing the FIG. 2 blade prior to removal of a rear section used to engage the blade during processing and attaching.
Figure 4:
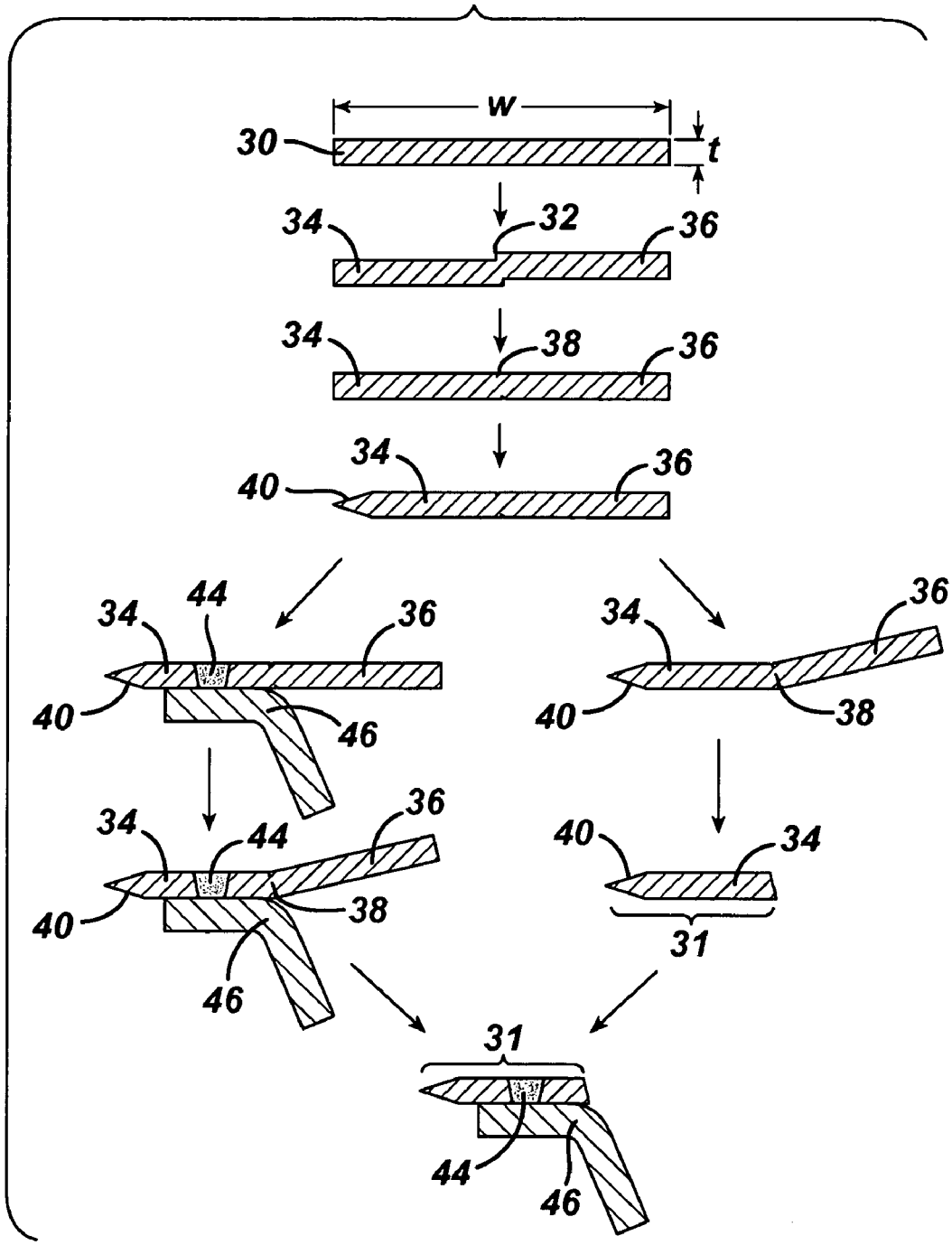
FIG. 4 is a flow chart of a method for making razor blades that also provides section views of the strip material and razor blades.

Referring to FIG. 4, a stainless steel strip material 30 is converted into razor blades 31. Strip material 30 has a thickness (t) between about 0.002 inch and about 0.006 inch (for example, about 0.003 inch or about 0.004 inch) and a width (w) sufficient to provide razor blade 31 after removable portion 36 (discussed below) is removed.

Strip material 30 is offset along its length in the thickness direction at region 32. After offsetting, strip material 30 has a blade portion 34 offset from a removable portion 36 by between about 10% and about 45%, and preferably between about 20% and 35%, of the thickness (t) of strip material 30. Region 32 is located between 25% and 75% of the distance between the front of blade portion 34 and the rear of removable portion 36.

Next, the offset strip material is flattened to remove at least 85% and preferably at least 90% or 95%, of the offset. During flattening, offset region 32 becomes weakened region 38.

The flattened strip material can be heat treated to harden the stainless steel (step not shown). The exposed end of blade portion 34 then is sharpened to provide cutting edge 40. The flattened strip material is relatively easy to handle during heat treatment and sharpening. After sharpening, the strip material is chopped into blade length sections (step not shown). Each blade length section includes a blade portion 34, with a blade edge 40, and a removable portion 36.

Two methods for providing razor blades 31 attached to supports 46 are shown in FIG. 4. In one method (left side of FIG. 4), a blade section is welded to support 46 at region 44. Removable portion 36 then is bent and broken off from blade portion 34 to provide a razor blade 31 attached to support 46. Alternatively (right side of FIG. 4), removable portion 36 is bent and broken from blade portion 34 to provide blade 31, which then is welded to support 46 at region 44.

Figure 5:
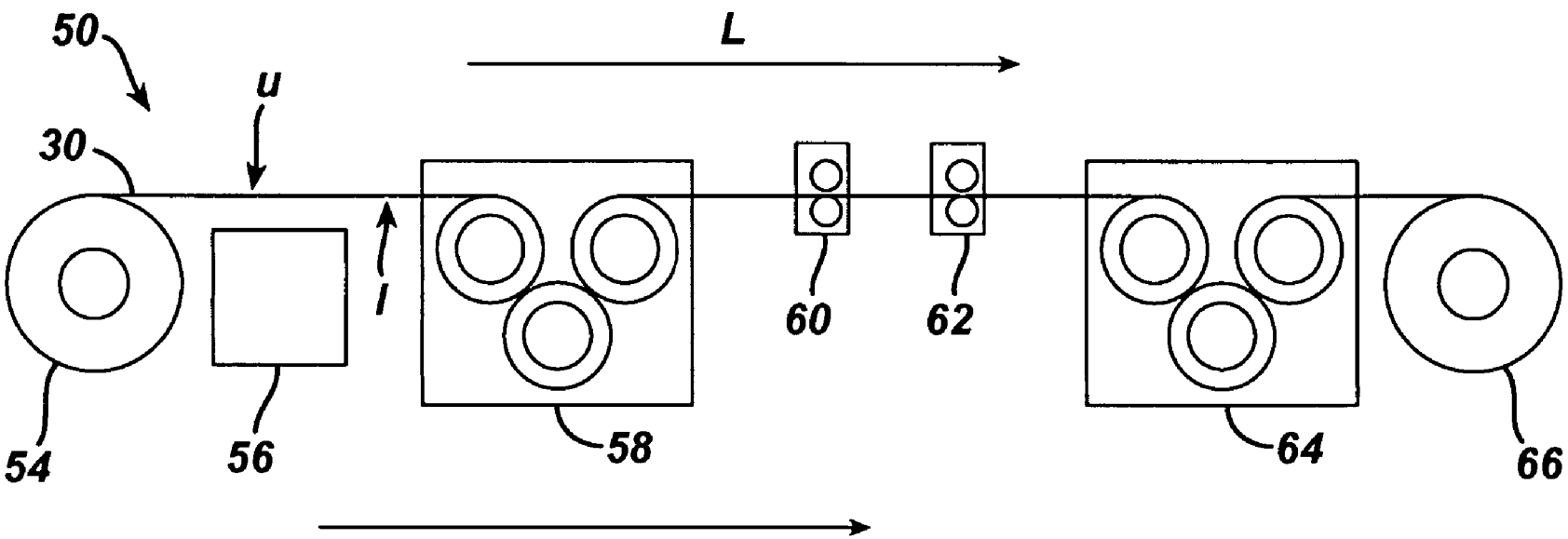
FIG. 5 is a diagrammatic plan view of a process line for performing some of the steps in FIG. 5.

Referring to FIG. 5, a process line 50 for performing the offset and flattening steps in FIG. 4 includes an unwind station 54 for providing a strip material 30. Strip material 30 moves lengthwise in direction L and has upper (u) and lower (1) surfaces. Strip material 30 passes through weld station 56 and tension leveling station 58. Weld station 56 is used when the end of one roll of strip material 30 needs to be attached to the end of a subsequent roll; tension leveling station 58 works with tension leveling station 64 to maintain the appropriate tension on strip material 30 during processing.

Strip material 30 next passes through offset station 60, which includes rollers that offset the strip material; offset rollers are described, for example, in U.S. Pat. No. 6,629,475, which is incorporated by reference herein. The offset strip material then passes between rollers at flattening station 62 that remove the offset.

Flattened sheet material 30 subsequently passes through tension leveling station 64 and is wound onto a spool at winding station 66. The flattened strip material then can be heat treated, sharpened, and made into razor blades. Heat treating and sharpening stations optionally can be provided prior to winding station 66.

Figure 6:
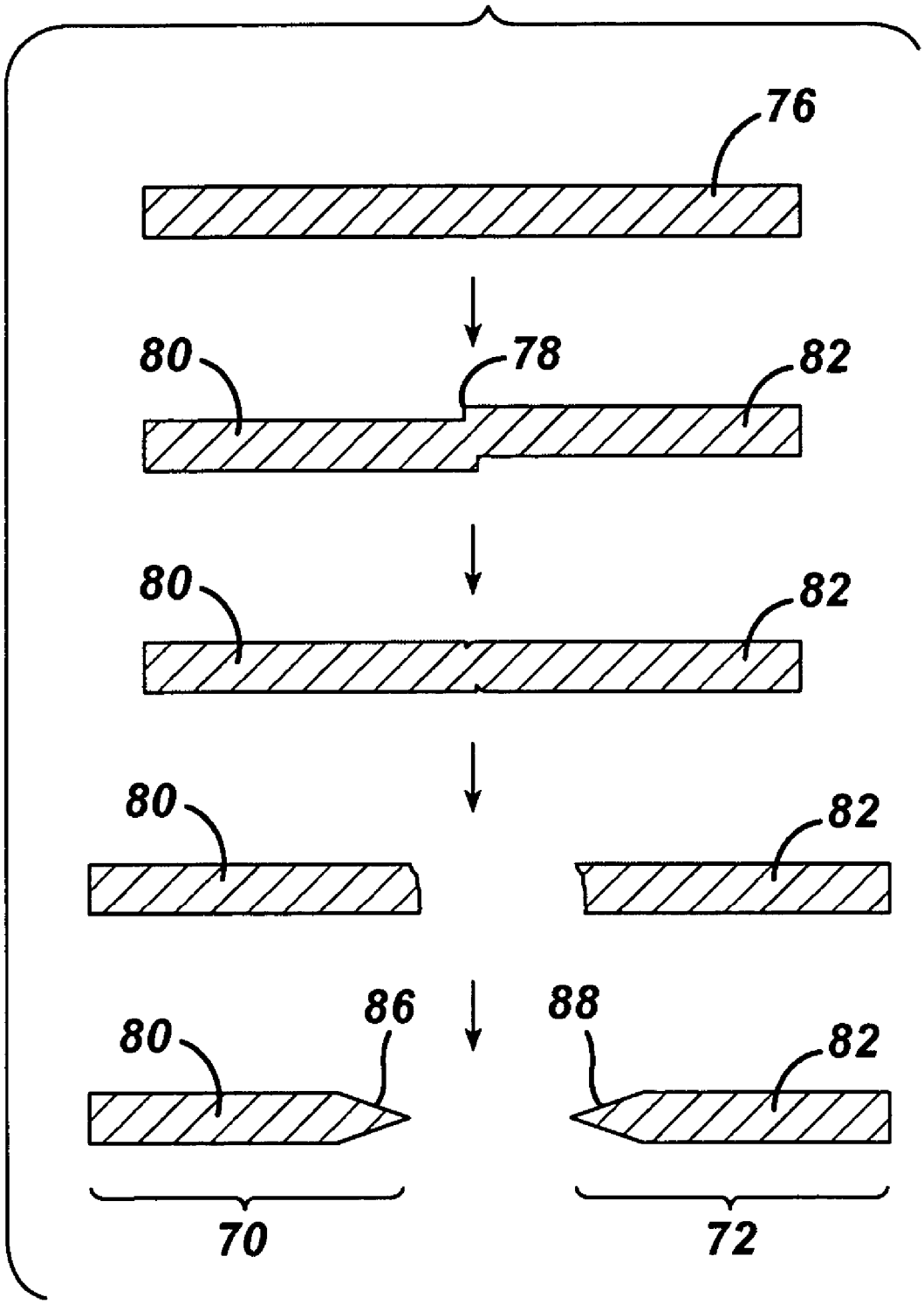
FIG. 6 is a flow chart of a method for making razor blades that also provides section views of the strip material and razor blades.

Referring to FIG. 6, a stainless steel strip material 76 is converted into razor blades 70. Strip material 76 has the approximate combined width of razor blades 70 and 72. Strip material is offset along its length at central region 78 to provide a first blade portion 80 and a second blade portion 82. The offset strip material is flattened and first blade portion 80 is separated from second blade portion 82. The flattened strip material can be heat treated (not shown) prior to or after the separation step. Lengthwise-extending edges of first portion 80 and second portion 82 are sharpened to provide blade edges 86 and 88, respectively. After sharpening, portions 80 and 82 are chopped into blade-length portions to provide a plurality of blades 70 and 72, respectively.

Figure 7:
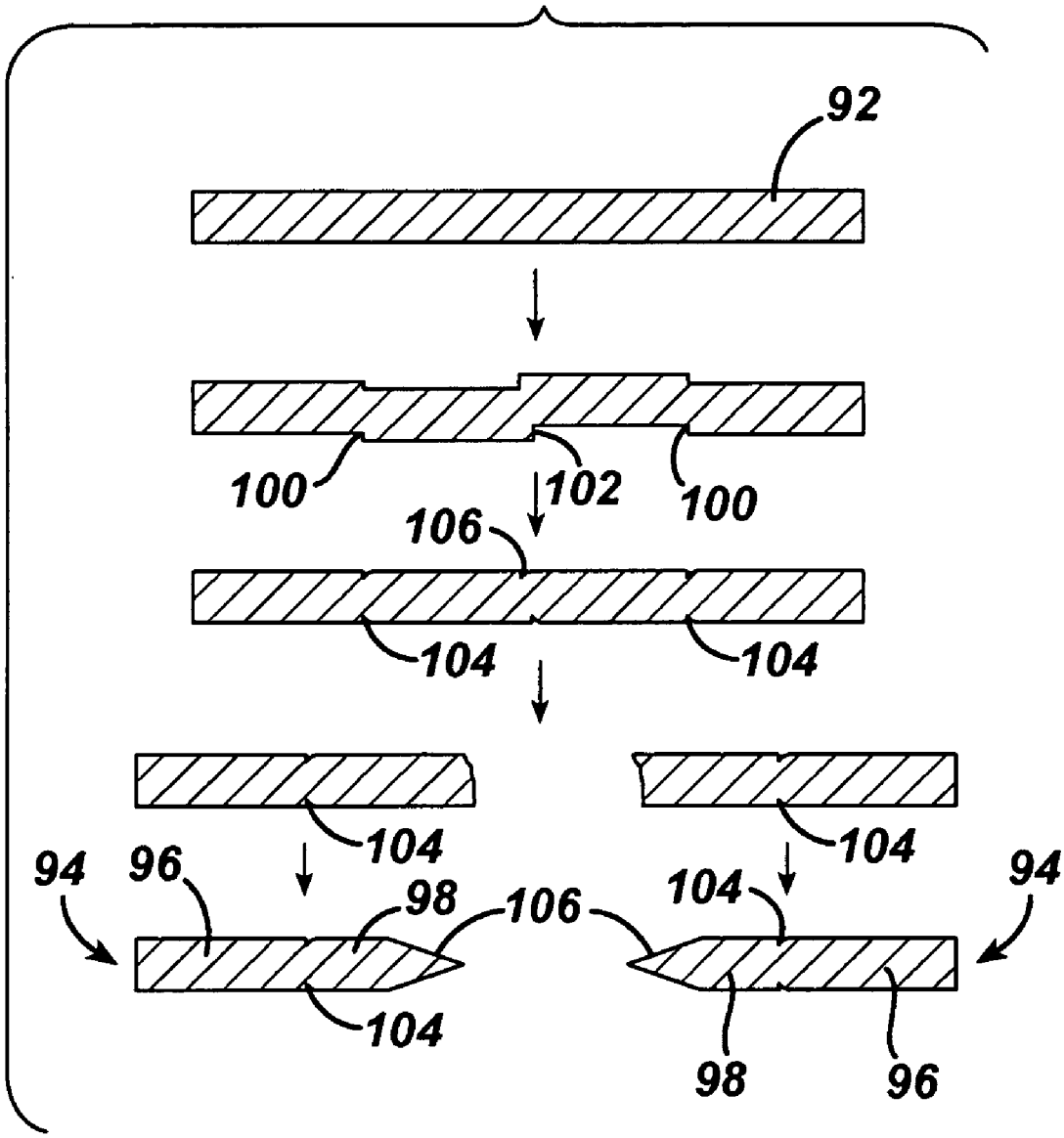
FIG. 7 is a flow chart of a method for making razor blades that also provide section views of the strip material and razor blade precursors.

Referring to FIG. 7, a stainless steel strip material 92 is converted into razor blade precursors 94 having blade portion 98 including blade edges 106, removable portions 96, and weakened regions 104. Strip material 92 is offset at regions 100 and at region 102. The offset at region 102 is larger than the offset at regions 100 (for example, at least 10%, 20%, or 30% larger).

The offset strip material then is flattened. During flattening, offset regions 100 become weakened regions 104 and offset region 102 becomes weakened region 106. Because the offset at region 102 was greater than the offset at regions 100, the flattened strip material generally can be separated more readily at weakened region 106 than at weakened regions 104; the notches at weakened region 106 have more depth region.

The flattened strip material is separated at weakened portion 106 into two portions, each with a weakened region 104. The flattened strip material can be heat treated prior to or after the separation step. The separated ends of the flattened strip material are sharpened to provide blade edges 106. After sharpening, the separated portions of the strip material are chopped to provide a plurality of blade length razor blade precursors 94.

Figure 8:
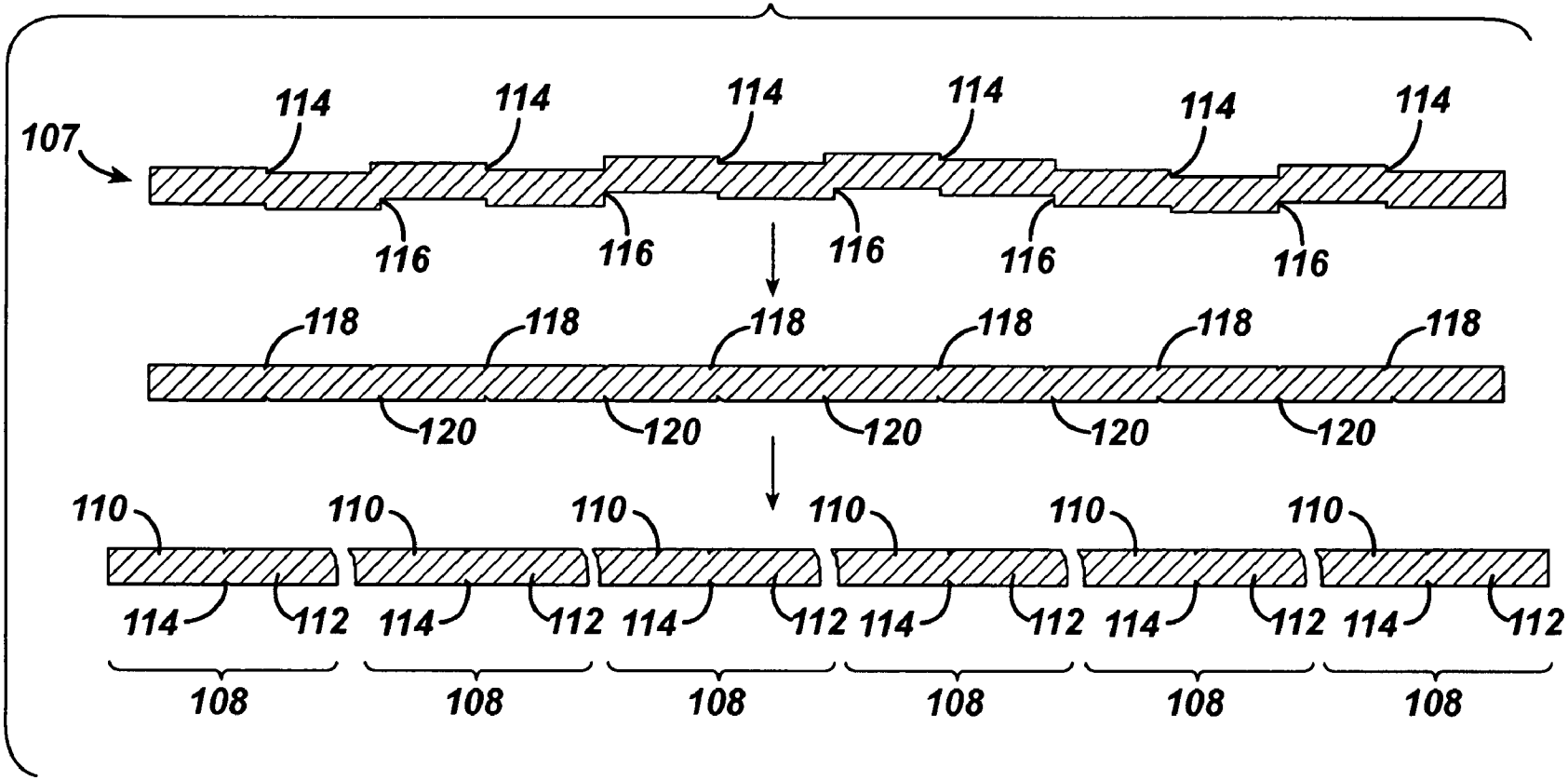
FIG. 8 is a flow chart of a method for making razor blades that also provides section views of the strip material.

Referring to FIG. 8, a stainless steel strip material is offset at regions 114 and regions 116. The offset at regions 116 is larger than the offset at regions 114. The offset strip material is flattened to provide a flattened strip material with weakened regions 118 and weakened regions 120. The flattened strip material is separated at weakened regions 120 into flattened strip material sections 108. Each section 108 includes a portion 110 and a portion 112, as well as a weakened region 114.

Either lengthwise-extending edges of strip material section 108 can be sharpened to provide a blade edge; the portion 110 or portion 112 not including the blade edge becomes a removable portion that can be detached subsequently to provide a razor blade.

The strip material can be selected to have a width sufficient to provide the number of razor blades used in a particular razor or razor cartridge. For example, strip materials 30, 76, and 92 can provide a series of razor blades for a razor or razor cartridge including two blades, and strip material 107 can provide razor blades for a razor or razor cartridge including six blades. Similarly, the width of the strip material can be selected to provide, for example, three, four, or five razor blades.

Other embodiments are within the claims For example, although the strip materials are offset and flattened on two surfaces in the processes shown in FIGS. 4-8, optionally the strip material can be offset and flattened on only one surface. Alternatively, the strip material also optionally can be weakened using any other method on one or both surfaces. Alternatively, when both the upper surface and lower surface are offset one surface can be offset more than the other.

Figure 9:
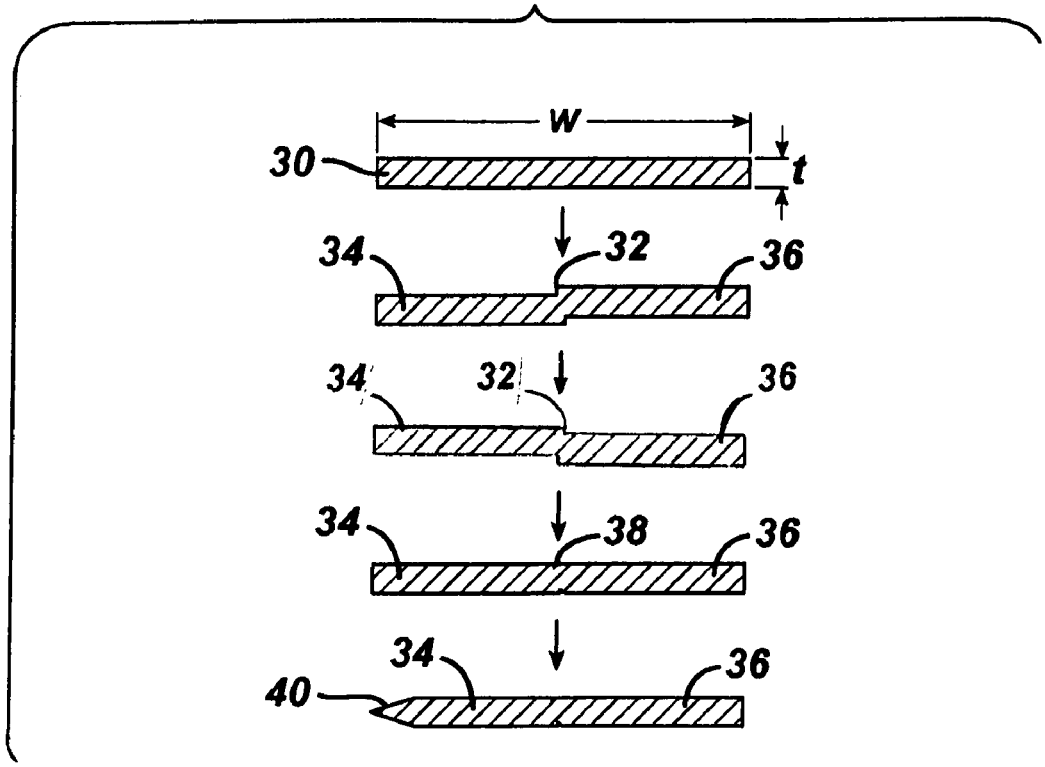
FIG. 9 is a flow chart of a method for making razor blades that also provide section views of the strip material.

Referring to FIG. 9, alternatively, a method of making a razor blade from a strip material 30 is shown. A a first lengthwise-extending portion 34 of the strip material 30 is offset from a second lengthwise-extending portion 36 of the strip material 30 at an offset location 32. The first lengthwise-extending portion 34 is offset from the second lengthwise-extending portion 36 of the strip material a second time at the offset location 32. The offset material then is flattened and converted into razor blades as described above, for example by sharpening a lengthwise-extending edge portion to a blade edge 40.

Figure 10:
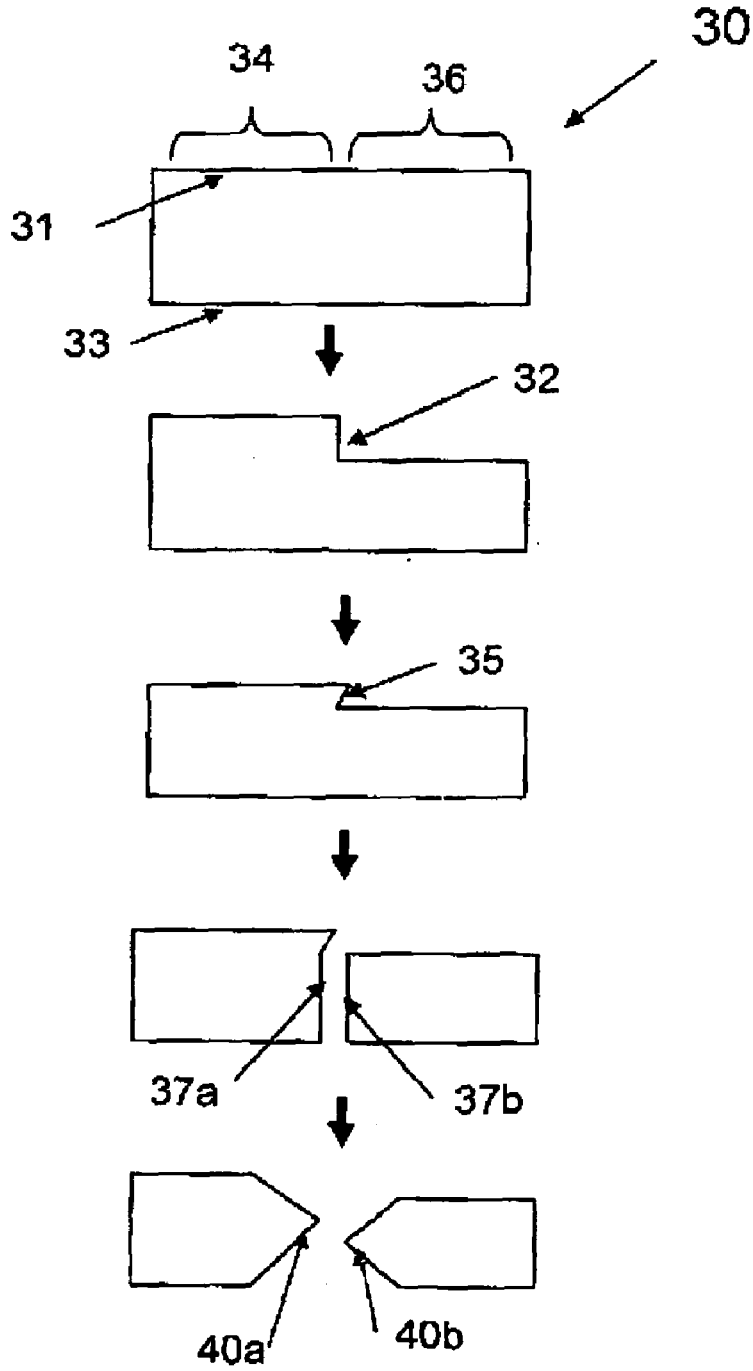
FIG. 10 is a flow chart of a method for making razor blades that also provide section views of the strip material.

Referring to FIG. 10, alternatively, a method of making a razor blade from a strip material 30 having an upper surface 31 and a lower surface 33 is shown. A first lengthwise-extending portion 34 of upper surface 31 of the strip material 30 is offset from a second lengthwise-extending portion 36 of upper surface 31 of the strip material 30 at an offset location 32. The offset may be produced by rolling or shaping along the length of strip 30. Lower surface 33 of strip material 30 is not offset. The offset location 32 is then flattened as shown at region 35 and while flattening, region 35 becomes weakened allowing for easy separation at region 35 as shown. After separation, portions 34 and 36 are converted into razor blades by sharpening the lengthwise extending edges on the separated portions 37*a* and 37*b* producing blade edges 40*a* and 40*b* to provide a plurality of blades.

In other alternative embodiments, any of the above procedures can be combined with the pressing procedures described in U.S. Ser. No. 11/259,528 and/or U.S. Ser. No. 11/259,552. Both were filed on the same day as the present application, are owned by the same owner as the present application, and are hereby incorporated by reference.

In other alternative embodiments, any of the above procedures can be combined with the procedures for thinning, and optionally for controlling the tension, described in U.S. Ser. No. 11/259,552. For example, one optional procedure includes (1) offsetting the strip material (optionally in combination with pressing) while also thinning the strip material, (2) adjusting the tension on the strip material to compensate for the added length of the strip material resulting from thinning, (3) offsetting the strip material a second time, at the same or different position(s) as the first offsetting step (again optionally combined with pressing), and (4) optionally flattening the strip material again. The tension in the strip material optionally also may be adjusted after step (3) and/or step (4), if either or both of these steps also significantly thin the strip material. Compare FIG. 5 of U.S. Ser. No. 11/259,552.

What is claimed is:

1. A method of manufacturing razor blades from a strip material having an upper surface and a lower surface, comprising (a) offsetting a first lengthwise-extending portion of only one of the surfaces from a second lengthwise-extending portion of the same surface, (b) flattening the first lengthwise-extending surface portion and the second lengthwise-extending surface portion to remove at least 50% of the offset;

(c) separating the first lengthwise-extending surface portion from the second lengthwise-extending surface portion;

(d) sharpening a lengthwise-extending edge on the separated first lengthwise-extending portion of the strip material at said offset.

2. The method of claim 1, wherein during step (a) the first lengthwise-extending surface portion is offset from the second lengthwise-extending surface portion by at least 10% of the thickness of the strip material.

3. The method of claim 1, wherein during step (a) the first lengthwise-extending surface portion is offset from the second lengthwise-extending surface portion by at least 20% of the thickness of the strip material.

4. The method of claim 1, wherein during step (b) at least 75% of the offset is removed.

5. The method of claim 1, wherein during step (b) at least 90% of the offset is removed.

6. The method of claim 3, wherein during step (b) at least 95% of the offset is removed.

7. The method of claim 1, wherein sharpening a lengthwise-extending edge occurs after step (b) and before step (c), the method further comprising (e) separating the first lengthwise-extending strip portion into razor blade length sections, each razor blade length section including part of the first lengthwise-extending surface portion and part of the second lengthwise-extending surface portion, wherein step (c) comprises separating the first lengthwise-extending strip portion from the second lengthwise-extending strip portion on the razor blade length sections to provide the razor blades.

8. The method of claim 7, further comprising attaching the razor blade length sections to a razor housing prior to step (c).

9. The method of claim 7, further comprising attaching the razor blades to blade support members of a razor housing after step (d).

10. The method of claim 1, wherein the first lengthwise-extending surface portion and the second lengthwise-extending surface portion are of approximately equal width.

11. The method of claim 10, wherein a lengthwise-extending edge of the first lengthwise-extending strip portion and a lengthwise-extending edge of the second lengthwise-extending strip portion are sharpened.

12. The method of claim 1, wherein strip material is a metal.

* * * * *